United States Patent [19]

Walsh et al.

[11] Patent Number: 4,717,133

[45] Date of Patent: Jan. 5, 1988

[54] LEG HOLDING AND POSITIONING DEVICE

[75] Inventors: Michael J. Walsh; Alexander E. Churches, both of Sydney, Australia

[73] Assignee: Unisearch Limited, Kinsington, Australia

[21] Appl. No.: 848,399

[22] PCT Filed: Jul. 15, 1985

[86] PCT No.: PCT/AU85/00154

§ 371 Date: Mar. 10, 1986

§ 102(e) Date: Mar. 10, 1986

[87] PCT Pub. No.: WO86/00521

PCT Pub. Date: Jan. 30, 1986

[30] Foreign Application Priority Data

Jul. 13, 1984 [AU] Australia ..... PG6000
May 13, 1985 [AU] Australia ..... PH00532

[51] Int. Cl.[4] ..... A61G 13/00
[52] U.S. Cl. ..... 269/328; 188/290
[58] Field of Search ..... 269/328; 188/290; 128/80 R, 80 A, 80 F

[56] References Cited

U.S. PATENT DOCUMENTS

| | | | |
|---|---|---|---|
| 1,516,795 | 11/1924 | Schwarting | 269/328 |
| 2,801,142 | 7/1957 | Adams | 269/328 |
| 3,211,396 | 10/1965 | McQuillen | 188/290 X |
| 3,817,512 | 6/1974 | Torrey | 269/328 |
| 3,865,216 | 2/1975 | Gryglas | 188/290 |
| 4,426,071 | 1/1984 | Kleustad | 269/328 X |

*Primary Examiner*—Robert C. Watson
*Attorney, Agent, or Firm*—Holman & Stern

[57] ABSTRACT

A leg holding and positioning device for use in surgical operative procedures comprising a housing (10) which is adapted for attachment to the rail (12) of an operating table (not shown) by means of a member (11) and a clamp (13) the housing having projecting from it a shaft (14) which is connected to a viscous damper or other device within the casing (10) to control rotation of the shaft (14), such device being associated with the control knob (18) whereby the shaft may be fixed in any one of a number of rotated positions. A member (25) is attached to one end of the shaft (14) and in use lies alongside the operative leg of a person on the operating table, the leg being secured to the member (25) by means of the bracket (32) and straps (35) and (36). The member (25) is preferably also capable of rotation about a virtual center at a point constituting the approximate center of a hib joint of a person on the operating table by means of pivotal movement between the member (25) and the shaft (14) and is arranged to be releasably secured in any of a plurality of rotated positions by means of holes arranged in an arc on the member (25) and engageable by a pin (28) passing through the shaft (14). Movement of the device involving rotation of the rotatable shaft (14) corresponds to the flexion or extension of the hip joint and movement of the second member (25) about the said virtual center corresponds to the abduction or adduction of the hip joint.

5 Claims, 5 Drawing Figures

LEG HOLDING AND POSITIONING DEVICE

CROSS REFERENCE TO RELATED APPLICATIONS

This U.S. application stems from PCT International Application No. PCT/AU85/00154 filed July 15, 1985.

The present invention relates to a leg holding and positioning device suitable for use in surgical operations on the leg of a patient.

As used throughout this specification, reference to the term "leg" should—unless otherwise indicated—be considered to refer to the combined upper and lower segments of the human lower limb.

Surgical operations on the leg, especially operations performed on the knee joint and/or surrounding tissues, often require the leg to be supported in a particular position or orientation. For example, optimal surgical access to the knee joint or other parts of the leg may require flexing of the hip up to about 90° and the knee up to about 160°, combined with abduction/adduction of the leg about the hip joint, varus/valgus rotation about the anterior-posterior axis through the knee and/or axial (internal/external) rotation of the foot.

Although it has previously been known to try to support the leg in the required position, the previously known devices have been cumbersome or inefficient, or indeed not suited for use in the sterile environment of an operating theatre. Hence, in many cases, the orthopaedic surgeon relies on the presence of an assistant to hold the patient's leg and to move it to the required positions. However, this is not entirely suitable for a number of reasons. Firstly considerable physical strength is required of the assistant, secondly the effects of fatigue associated with the long surgical procedures produce the possibility of slight inadvertent movements occurring at critical phases of the procedure.

In many cases, the assistant who is required to hold the leg will be an assistant surgeon—because the task may be too exhausting for normal nursing staff, or because the angle at which the leg is held is critical to the success of the operation and requires expert knowledge—and this is inefficient use of the skills and training of the assistant surgeon.

It is an object of this invention to provide a device suitable for holding the leg of a patient during surgical procedures on the leg.

It is another object of this invention to provide such a leg holding device which permits orientation of the patient's leg to the position required for the various surgical procedures on the leg or knee joint and which provides rigid support for the leg during the operation, thereby relieving the assistant of physical effort enabling him to assist directly with the procedure.

It is a further object of this invention to provide a leg holding device which is substantially adjustable to the required operative position of the patient's leg, which is readily adjustable during the operative procedures and which is preferably autoclavable or otherwise sterilisable to the requirements of the surgical environment.

According to the present invention there is provided a leg holding and positioning device for use in surgical operative procedures, said device comprising a housing, a member downwardly extending therefrom and adapted to be adjustably attached to a side rail of a surgical operating table for movement upwardly and downwardly and along said rail, a rotatable shaft extending through a sidewall of the housing, means within said housing to control the rotation of said rotatable shaft about an axis lying in a plane substantially parallel to the top surface of the operating table and for fixing said shaft in any one of a plurality of positions of rotation, the free end of said rotatable shaft having fixed thereto a second member extending substantially radially from it and arranged to be positioned to lie alongside the operative leg of a person on the operating table, and means on the second member for releasably attaching said operative leg thereto.

The rotation of the rotatable shaft is controlled by any suitable means, such as, for example, gear means in said housing controllable by operative means outside the housing, or a rotatable disc within the housing, where the said housing may contain an oil or viscous damper or friction means acting on said disc, and external means to act on said disc to stop rotation thereof at any given point.

Preferably, the second member attached to the rotatable shaft is adapted for limited rotation in relation thereto through an arc about an axis at right angles to the axis thereof, the attachment mechanism being such that pivoting occurs about a virtual centre at a point constituting the approximate centre of a hip joint of the person on the operating table, and is adapted to be releasably secured in any one of a plurality of available positions through the described semi-arc.

Preferably, the means for attaching the operative limb to the second member comprises a support bracket for the patient's thigh which is pivotally attached to the second member to facilitate rotation of the support bracket, whereby the holding device is suitable for mounting on either side of the operating table to support either leg of a patient. When transferring the leg holding device from one side of the operating table to the other, the rotatable shaft, together with the attached second member is rotated through an arc of up to 360° to he support bracket is similarly rotated about its pivot point to ensure the correct orientation for attachment to either the left or right leg of the patient.

Suitable electrical isolation of metallic components is provided to obviate the risk of burns or electrical shock to the patient if using diathermy or other procedures.

In order that the invention may be better understood and put into practice a preferred form thereof is hereinafter described, by way of example, with reference to the accompanying drawings, in which.

Figure 1:
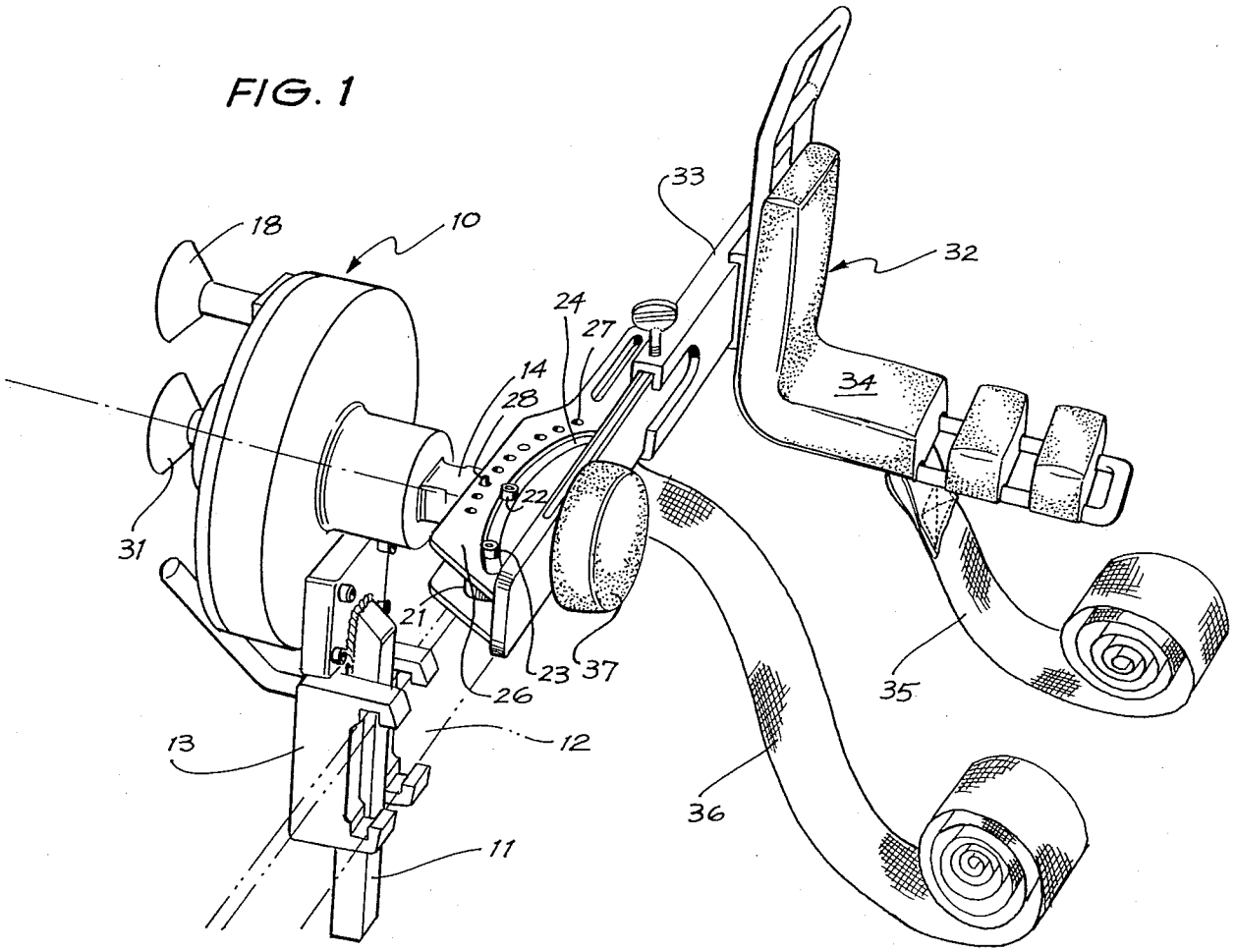
FIG. 1 is a perspective view of an apparatus according to the invention.

The leg holding device as depicted comprises a cylindrical housing 10 having a first member in the form of a bar 11 downwardly extending therefrom which bar is attached to a side rail 12 of an operating table by a manually adjustable clamp 13 such that the leg holding device is attached to the operating table at the required height and longitudinal position relative to the operating surface.

A rotatable shaft 14 extends axially and centrally from the cylindrical housing 10 and is rotatable about an axis in a plane substantially parallel to the operating table surface. The rotatable shaft 14 is connected to a disc member 15 fitting closely in and rotatable in the housing 10, which is filled with oil, which acts as a friction damper to slow rotation of the disc 15 and the rotatable shaft 14, to prevent sudden movement of the patient's leg when attached to the leg holding device. The disc member 15 is provided with a plurality of spaced apart holes 16 about its outer periphery adapted to receive a pin member 17 which extends through the peripheral end wall of the housing 10 to lock the disc member 15 in any required position of rotation. The pin 17 terminates in an operating knob 18.

As the interior of the housing not occupied by the disc is filled with silicone oil suitable seals are provided to prevent leakage and internal passages are provided to allow for internal flow of oil where necessary e.g. through the disc 15 and from the aperture into which the end of pin 17 is received.

Figure 2:
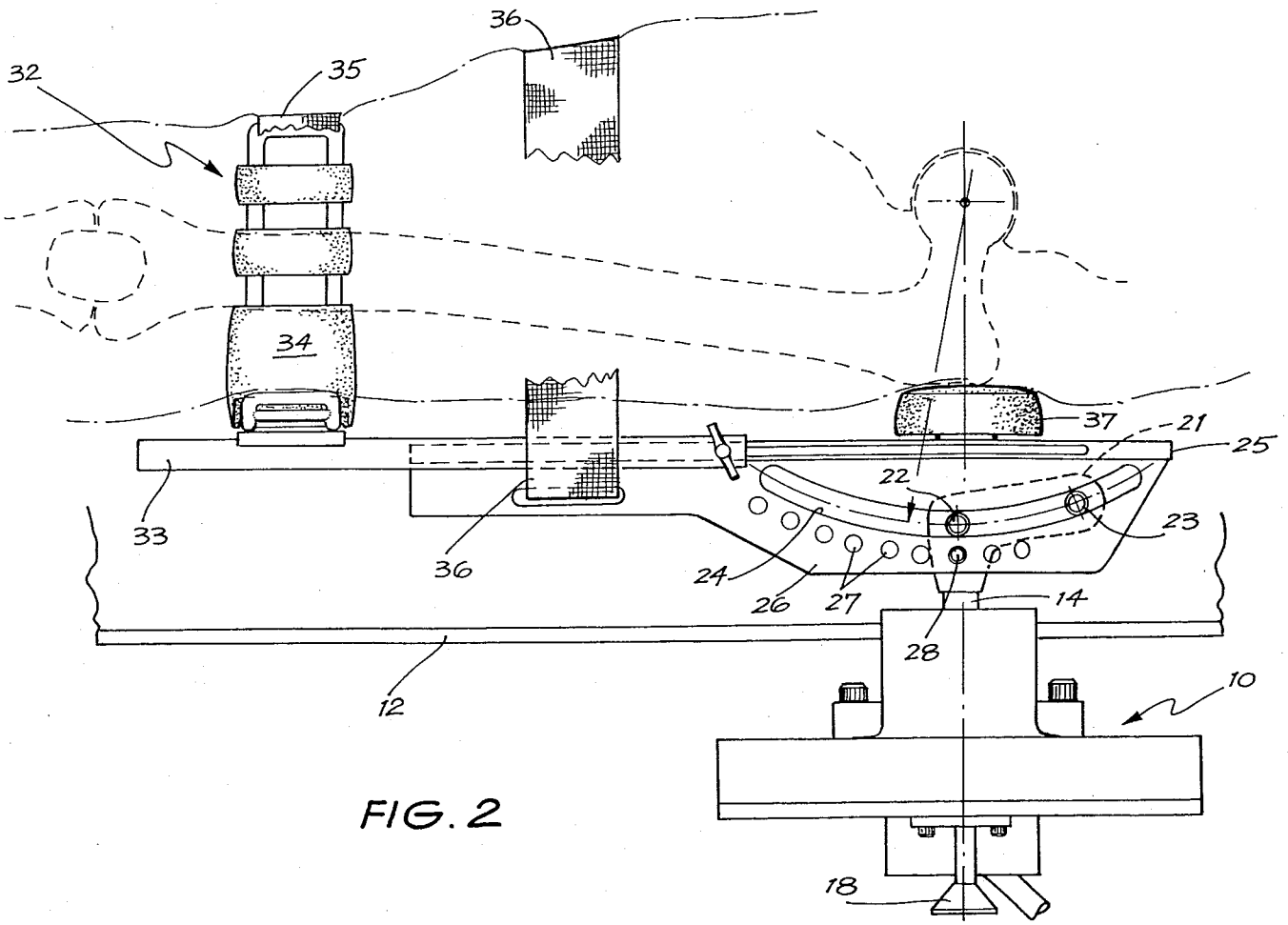
FIG. 2 is a view of the apparatus in the direction of the arrow B of FIG. 1.
Figure 3:
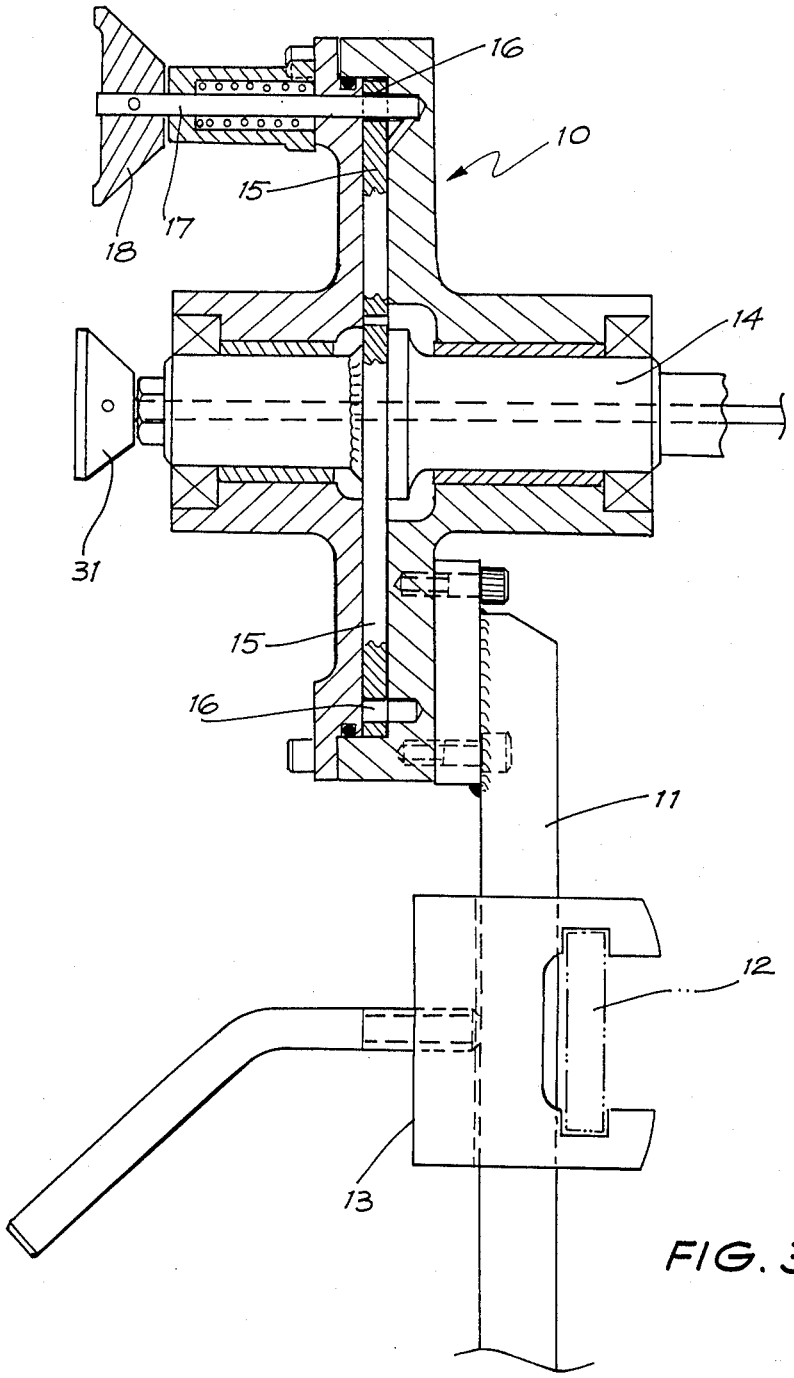
FIG. 3 is a sectional view of the apparatus on line A—A of FIG. 2.

The rotatable shaft extending from the housing 10 is substantially L-shaped, having an axially-directed component extending from the housing and a radially directed component 21 (see FIG. 2) at its far end. The radially directed component of the rotatable shaft is provided with two lugs 22 and 23 or bearings which act as guides for the arcuate slot 24 at one end of the second member 25, which is rotatably engaged with the end 21 of the rotatable shaft 14. On a flange 26 of the second member 25, inwardly directed towards the housing, there is provided a plurality of spaced apart holes 27 in an arc concentric with the abovementioned arcuate slot 24, which holes 27 are adapted to receive a movable locking pin 28 operable by means of the central axial knob 31 acting through the rotatable shaft, thus providing a releasable locking device to lock releasably the second member 25 in any position of rotatable engagement with the rotatable shaft 14 along the slot 24 of the second member 25. Rotation of the second member 25 along slot 24 corresponds to the abduction or adduction of the hip joint. This form of the invention allows any combination of abduction/adduction and flexion/extension of the hip joint within the total range of the device.

A substantially L-shaped thigh support bracket 32 is pivotally connected to the second member by means of a member 33 which is slidably mounted on the second member. The L-shaped bracket 32 is provided with a padded surface 34 to support the thigh of the patient, which is held in place by means of a strap 35 (e.g. a "Velcro" (Registered Trade Mark) strap).

The use of an arterial tourniquet is mandatory in leg surgery of the type envisaged and the invention may incorporate this tourniquet as part of the means for securing the thigh to the L-shaped support bracket, in which case the tourniquet also provides padded support for the thigh.

Preferably, one or more additional straps 36 are provided along the length of the second member 25 to facilitate securement of the thigh of the patient's operative leg to the leg holding device.

Preferably also, the L-shaped thigh support bracket 32 is provided with a plurality of strap attachment points as shown in FIG. 1 to allow for the varying size of patients, from small children to large adults.

A padded disc 37 is provided on the external side of the second member 25 substantially adjacent to the end of the rotatable shaft 14 at its points of attachment to the second member to provide a cushioned support for the hip and to prevent pressure damage to the hip or to parts of the patient's leg in contact with the device during surgical procedures.

In use, the leg holding device is attached to a side rail 12 of an operating table with the axis of the rotatable shaft 14 and the padded disc 37 aligned with the hip joint of the patient (approximately 20 mm cranial from the greater trochanter) and the second member 25 approximately parallel to the long axis of the femur.

The L-shaped thigh support bracket 32 is slidably positioned along the second member 25 and the bracket 32 is rotated about its pivot point to the desired orientation. The thigh of the operative leg of the patient is placed onto the bracket 32 and is secured therein by means of straps 35 and 36 and/or a tourniquet.

The disc 15 in the housing 10 is allowed to rotate by withdrawing pin 16, the thigh may then be raised or lowered (flexion/extension) until the leg is in the required position, from full extension to full flexion, after which the pin 16 is re-engaged to secure the leg in the selected position.

The part of the leg below the knee is free to be manipulated to obtain the desired degree of varus/valgus orientation or axial rotation.

With the operative limb in the required position for the surgical operative procedures, the limb can be draped in the conventional manner leaving the operative site exposed and providing ready access for the surgeon to the operative site, with the limb held securely and rigidly without the need for further external support by the assistant surgeon or other personnel.

Once the leg is in the operative position the skin of the operative site is then prepared with iodine in the usual manner and the leg is draped in the usual manner. With the thigh secured in the required position, the leg is positioned securely before the surgeon in any position from full extension to full flexion. Abduction/adduction of the hip joint may be superimposed anywhere throughout the range of flexion/extension, for example to facilitate such operations as arthroscopy.

All parts of the leg holding device which would not normally be covered by drapes are designed to be autoclavable or otherwise sterilisable by conventional means. Stainless steel and other autoclavable materials are preferably employed in the construction of the device. All clamps and movable joints are designed such that they can be adjusted or moved by external operation through the sterile drapes which cover the particular clamp or joint.

Figure 4:
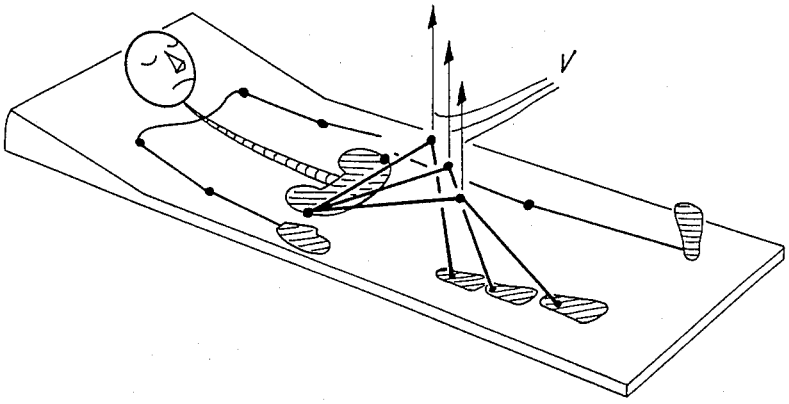
FIGS. 4 and 5 are diagrams illustrating the capabilities of the apparatus.
Figure 5:
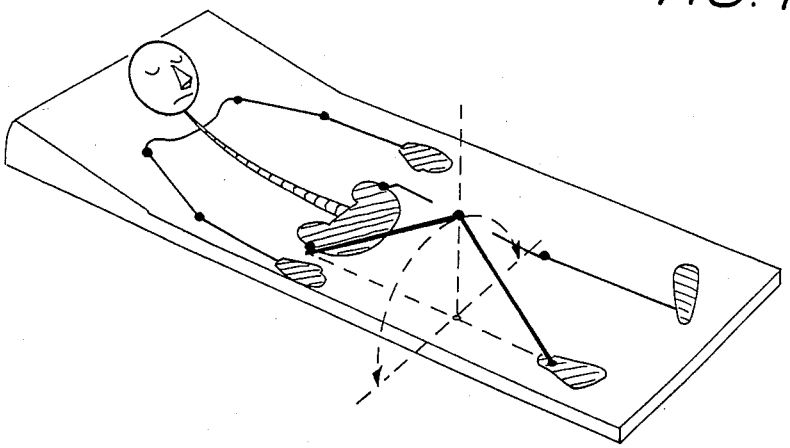

The diagram of FIG. 4 shows how the knee position of the operative leg of a patient (in this case a right leg) may be adjusted in flexion or extension, the knee moving in the direction of the arrows indicated at V. This adjustment is effected by rotation of the disc 15 in the housing 10. FIG. 5 illustrates diagrammatically the manner in which the operative leg of the patient may be adjusted in abduction or adduction in the direction of the arrows. This adjustment is effected by means of the arcuate slot 24 in the second member 25 in those forms of the invention which include this feature.

The leg holding device according to the present invention is useful for all forms of surgical procedures of the leg, and especially for knee surgery. Other advantages include the fact that the device is adjustable to hold the operative leg in any desired position (with required reproducable movements of the knee joint being effected by orientation of the device in the required plane or planes), with the leg being positively held, relieving the assistant of continuing physical effort, and without intruding into the operative field.

It will be recognised by persons skilled in the art that numerous variations and modifications may be made to the invention as described above without departing from the spirit or scope of the invention as defined in the succeeding claims.

We claim:

1. A leg holding and positioning device for use in surgical operative procedures, the device comprising a housing assembly, a member extending downwardly from the housing assembly with means for adjustably attaching to a side rail of a surgical operating table for movement upwardly and downwardly and along said rail, a part of said housing assembly being rotatable relative to said member about an axis lying in a plane substantially parallel to a top surface of an operating table to which the device is attached, means within the housing assembly for controlling rotation of said rotatable part and for fixing same in any one of a plurality of positions of rotation, a second member attached to said part extending substantially radially from the axis of rotation of said part so as to permit limited rotation in relation thereto through an arc about an axis at right angles to the axis thereof, the attachment being such that pivoting occurs about a virtual center at a point constituting the approximate center of a hip joint of the operative leg and having means to releasably secure said second member in any one of a plurality of positions of rotation through said arc and positioned to extend alongside an operative leg of a person on the operating table, and means on the second member for securely but releasably attaching the thigh of said operative leg thereto the arrangement permitting controlled movement of the operative leg in flexion—extension and abduction—adduction about the hip joint.

2. A leg holding and positioning device as claimed in claim 1, wherein the means within said housing to control the rotation of said rotatable shaft consist of a viscous damping device and means for locking said device in any one of a plurality of rotated positions.

3. A leg holding and positioning device as claimed in claim 2 wherein said viscous damping device consists of a disc mounted on said shaft and fitting closely within an oil containing cavity of said housing, the disc having circumferentially spaced holes, manually operable detent means on said housing, being engageable with any one of said holes to fix the disc in a rotated position.

4. A leg holding and positioning device as claimed in claim 1 wherein the means on the second member for releasably attached said operative leg thereto comprises a support bracket for a patient's thigh, the support bracket being pivotally attached to the second member to facilitate rotation of the support bracket whereby the holding and positioning device is suitable for mounting on either side of an operating table to support either leg of a patient.

5. A leg holding and positioning device as claimed in claim 4 wherein the means on the second member for releasably attaching said operative leg thereto is movable along the length of the second member, means being provided to fix it in any adjusted position.

* * * * *